United States Patent [19]

Russell

[11] 4,034,697

[45] July 12, 1977

[54] FIRE EXTINGUISHER CABINET

[75] Inventor: Walter E. Russell, Frederick, Md.

[73] Assignee: A-T-O Inc., Willoughby, Ohio

[21] Appl. No.: 655,276

[22] Filed: Feb. 4, 1976

[51] Int. Cl.[2] ..... G08B 21/00; G08B 13/08

[52] U.S. Cl. ..... 116/100; 49/13; 116/86; 169/51; 340/274 R

[58] Field of Search ..... 116/5, 85, 86, 100; 169/51; 49/13–14; 340/274 R, 280

[56] References Cited

U.S. PATENT DOCUMENTS

| | | | |
|---|---|---|---|
| 3,067,822 | 12/1962 | Hattenhauer | 169/51 |
| 3,145,375 | 8/1964 | Webb | 340/280 |
| 3,732,843 | 5/1973 | Pappas et al. | 116/86 |
| 3,957,012 | 5/1976 | Fegley et al. | 116/85 X |

FOREIGN PATENT DOCUMENTS

| | | | |
|---|---|---|---|
| 57,796 | 11/1924 | Sweden | 116/85 |
| 1,356,372 | 6/1974 | United Kingdom | 169/51 |

*Primary Examiner*—Richard C. Queisser
*Assistant Examiner*—Charles Gorenstein
*Attorney, Agent, or Firm*—Webster B. Harpman

[57] ABSTRACT

A fire extinguisher cabinet protectively encloses a fire extinguisher of the portable type and provides a transparent movable access panel through which the fire extinguisher may be readily seen. Movement of the access panel actuates an audible alarm to indicate that the cabinet has been opened. The cabinet discourages theft of the fire extinguisher as the same cannot be removed therefrom without opening the access panel and actuating the alarm unless a key controlled lock and actuating arm is moved to inactive position prior to moving the access panel.

5 Claims, 8 Drawing Figures

FIRE EXTINGUISHER CABINET

BACKGROUND OF THE INVENTION

1. Field of the Invention

This invention relates to cabinets in which portable fire extinguishers may be positioned for convenient access in case of a fire.

2. Description of the Prior Art

Prior structures of this type have provided cabinets in which portable fire extinguishers may be positioned, see for example U.S. Pat. No. 3,042,910 wherein a cabinet with a hinged door is provided with oppositely disposed pressure plates normally engaging the sides of the extinguisher therein, the arrangement is such that removal of the enxtinguisher actuates an alarm controlled by the pressure plates normally engaging the sides of the extinguisher therein.

The prior art includes several devices which support or otherwise hold fire extinguishers and incorporate alarm devices actuated by movement of the supporting devices, for example hooks on which the fire extinguishers can be suspended. See U.S. Pats. Nos. 2,683,260, 2,754,498, 2,965,890, 3,145,375 and 3,644,920.

The present invention provides a cabinet with a transparent drop front and built in alarm means which is actuated when the drop front is moved to permit the fire extinguisher to be removed from the cabinet.

SUMMARY OF THE INVENTION

A fire extinguisher cabinet comprises a wall mounted box of a size sufficient to enclose a portable fire extinguisher, a transparent slidable front panel normally closes the box and is held in closed position by a simple latch which upon manuel actuation drops the panel and permits the fire extinguisher to be removed from the cabinet. An audible alarm device is positioned in the cabinet and normally held inopertive by a trigger arm. A key controlled lock having an actuating arm for engaging and moving the trigger arm is positioned through the transparent slidable front panel. Actuation of the key controlled lock will move the actuating arm to a second position where it will not engage the trigger arm of the alarm device. The cabinet carries warnings of the audible alarm which will sound if the cabinet is opened before the actuating arm of the lock mechanism is disengaged. The cabinet thus substantially deters theft of the fire extinguisher therefrom and/or sounds the audible alarm in the event of a fire and the legitimate removal of the fire extinguisher for its indicated purpose.

DESCRIPTION OF THE PREFERRED EMBODIMENT

Figure 1:
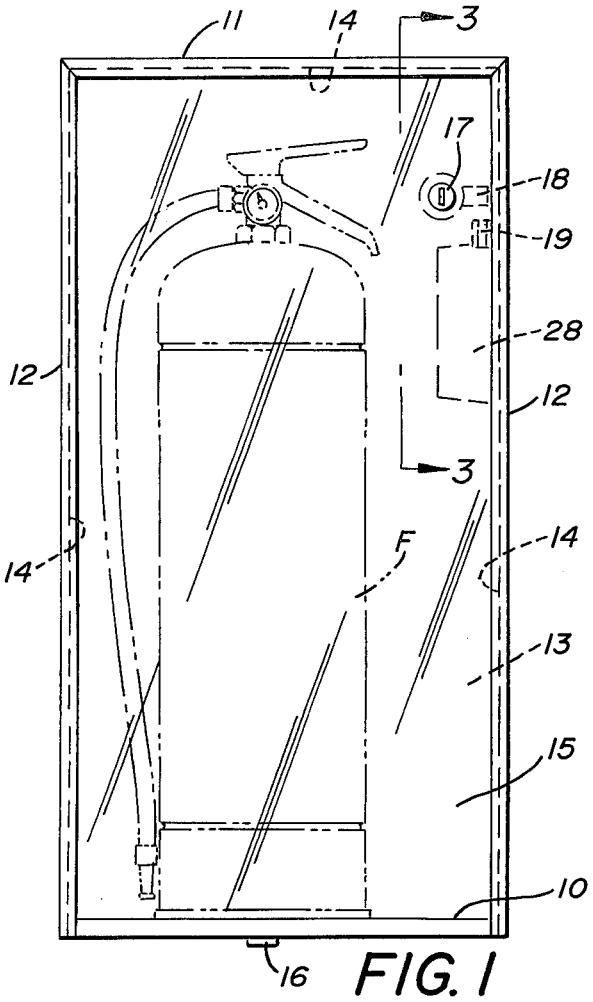
FIG. 1 is a front plan view of the fire extinguisher cabinet with broken lines indicating a fire extinguisher positioned therein and behind the transparent front panel thereof.
Figure 2:
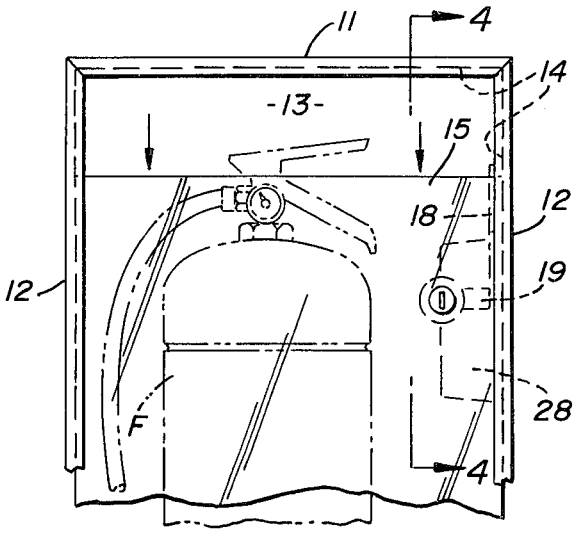
FIG. 2 is a front plan view of a portion of the fire extinguisher cabinet seen in FIG. 1 showing the transparent front panel moved downwardly to alarm actuating position.

By referring to FIGS. 1 and 2 of the drawings the fire extinguisher cabinet may be seen and in FIG. 1 a broken line representation of a fire extinguisher F is illustrated positioned on a bottom 10 of a rectangular cabinet including top and side walls 11 and 12 respectively and a back panel 13. The forward edges of the sides 12 and the top 11 define inwardly turned channels 14. There is no comparable channel on the forward edge of the bottom 10 of the cabinet. A transparent slidable front panel 15 is movably positioned in the inturned channels 14 and held in a position closing the front of the fire extinguisher cabinet by a manually movable latch 16 mounted on the bottom 10 of the cabinet. A key actuated cylinder lock assembly 17 is positioned in an aperture in the upper right hand portion of the transparent slidable front panel 15 and arranged to move an actuating arm 18 in an arc based on the axis of the cylinder lock assembly 17.

Figure 3:
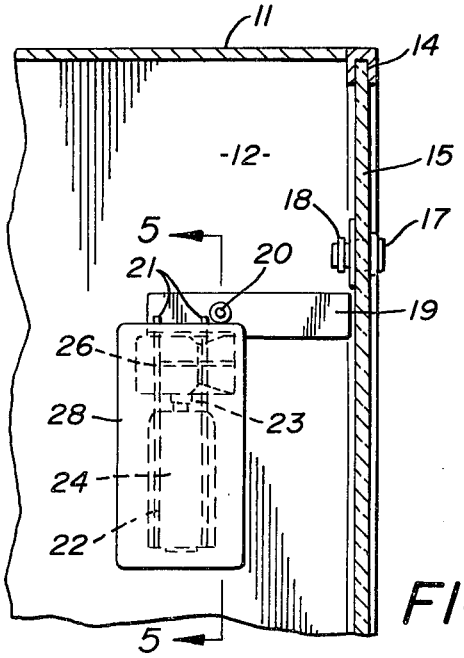
FIG. 3 is a vertical section on line 3—3 of FIG. 1.
Figure 4:
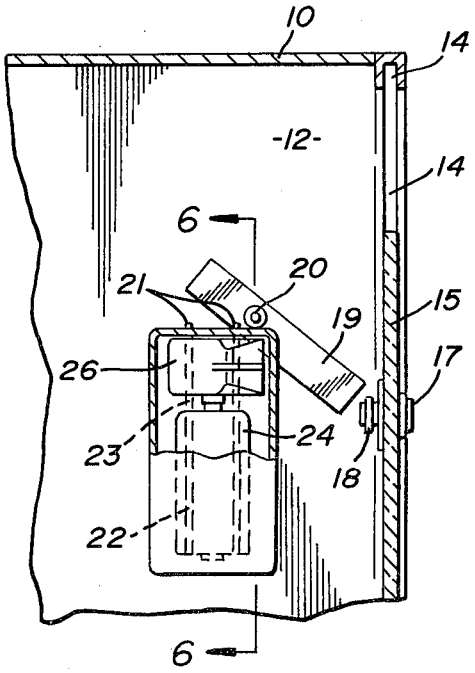
FIG. 4 is a vertical section on line 4—4 of FIG. 2.

In FIG. 1 of the drawings the actuating arm 18 is shown in horizontal position and overlying one end of a trigger arm 19 which is pivoted intermediate its ends by a pivot 20 to the side wall 12. The arrangement is best illustrated in FIGS. 3 and 4 of the drawings and by referring to FIG. 3 it will be seen that the one end of the trigger arm 19 is positioned in spaced relation below the actuating arm 18. This relative positioning of the arms 18 and 19 is maintained as long as the transparent slidable front panel 15 is in elevated position closing the front of the fire extinguisher cabinet.

By referring now to FIG. 2 of the drawings, the transparent front panel 15 is shown moved downwardly relative to the top 11 and the trigger arm 19 is shown after having engaged the end of the actuating arm 18 and moved it to a second position as best seen in FIG. 4 of the drawings. The trigger arm 19 normally is engaged behind a pair of horizontally spaced members 21 which are formed on the upper end of a vertically positioned cross sectionally channel shape mounting bracket 22. An elongated leaf spring 23 is affixed to the mounting bracket 22 and is normally held in vertical position by the trigger arm 19 as best seen in FIGS. 3 and 5 of the drawings.

Figure 5:
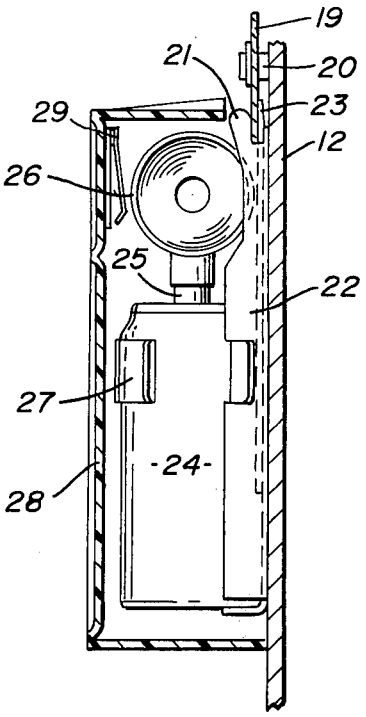
FIG. 5 is a vertical section on line 5—5 of FIG. 3 showing a detail of the alarm device in inoperative position.
Figure 6:
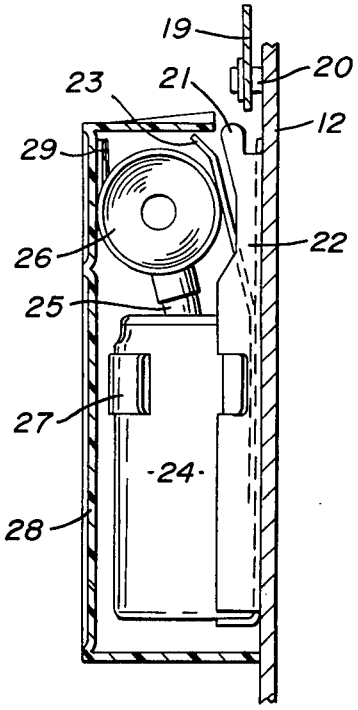
FIG. 6 is a cross sectional view similar to FIG. 5 showing the alarm device in actuated position.

Still referring to FIGS. 5 and 6 of the drawings it will be seen that the bracket 22 which is mounted on the wall 12 of the extinguisher cabinet and on the inside thereof normally supports a compressed gas container 24 which has an actuating valve and stem 25 in its uppermost end on which is positioned a horn 26, the arrangement is such that when the stem 25 is moved from its normal vertical position the valve therein opens and the compressed gas contents of the container 24 are discharged through the horn 26 to create a loud sound.

It will thus be seen that as a direct result of moving the latch 16 and dropping the transparent slidable front panel 15 to gain access to the fire extinguisher F, the horn 26 is actuated and an audible alarm given.

Figure 7:
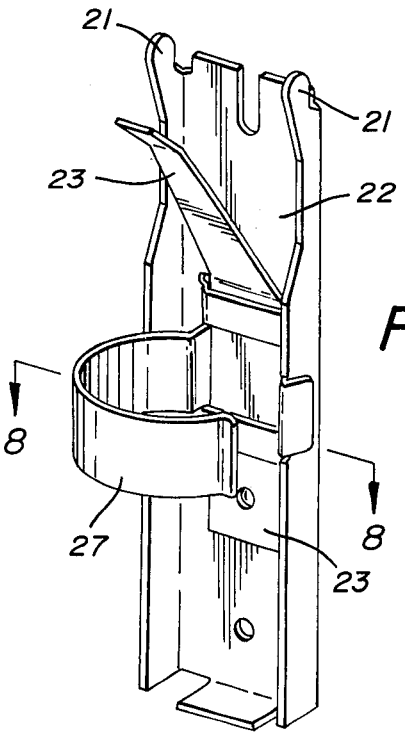
FIG. 7 is a perspective view of a portion of the alarm device seen in FIGS. 5 and 6.
Figure 8:
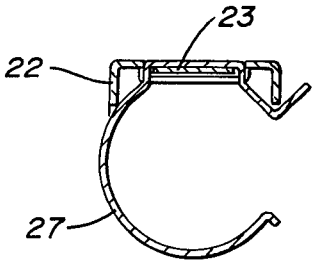
FIG. 8 is a horizontal section on line 8—8 of FIG. 7.

In FIGS. 7 and 8 of the drawings, details of the bracket 22, the spring 23 and a clamping bond 27 may be seen and will be recognized as the means for holding the gas container 24 in operative position in the bracket 22.

The bracket 22, the pressure container 24, the valve stem 25 and the horn 26 are commercially available items, normally actuated by a slide piece holding the spring 23 in vertical position with the slide piece being attached to a chain which in turn is attached to a window sash, a door, or the like so that the alarm is sounded when the window or the door is opened.

In FIGS. 2–6 the alarm device is shown enclosed in a housing 28 which may be removed to permit replacement of a recharged compressed gas container 24, etc.

It will thus be seen that a fire extinguishing cabinet has been disclosed in which a portable fire extinguisher may be conveniently positioned and that it is readily available by actuating a simple manual latch 16 and permitting the transparent slidable front panel 15 of the cabinet to drop downwardly.

It will also be observed that when this occurs an audible alarm will be given, if desired an electric switch 29 can be incorporated in the audible alarm device and connected by a suitable electric circuit with an adjacent or a remote audible or visible alarm is desired.

Although but one embodiment of the present invention has been illustrated and described, it will be apparent to those skilled in the art that various changes and modifications may be made therein without departing from the spirit of the invention and having thus described my invention what I claim is:

1. A fire extinguisher cabinet and alarm comprising an enclosure arranged to hold and display a portable fire extinguisher, a removable transparent access panel in said enclosure, means in said panel having a movable actuating arm on an inner side of said panel and an alarm device positioned in said enclosure, a trigger member in said alarm device arranged for engagement by said actuating arm when said actuating arm is in a first position and when said transparent access panel is moved to provide access to said enclosure and the portable fire extinguisher therein, said movable actuating arm being movable from said first position to a second position where it cannot engage said trigger member, said trigger member arranged to actuate said alarm device.

2. The fire extinguisher cabinet and alarm set forth in claim 1 and wherein said removable transparent access panel forms the front of said enclosure, means on said enclosure defining vertical oppositely disposed channels, said access panel being slidably disposed therein and a latch on said enclosure normally holding said panel in closed position on said enclosure.

3. The fire extinguisher cabinet and alarm set forth in claim 1 and wherein said audible alarm device comprises an air horn and a container of gas under pressure and valve means therefor, a spring arranged for actuating said valve means to open said valve and actuate said air horn, said trigger member in said alarm device normally holding said spring in inoperative position.

4. The fire extinguisher cabinet and alarm set forth in claim 1 and wherein said means in said panel having said actuating arm comprises a key actuated cylinder lock positioned in an opening in said panel.

5. The fire extinguisher cabinet and alarm set forth in claim 1 and wherein a switch is disposed in said alarm device and a circuit controlled by said switch in communication with a secondary alarm.

* * * * *